US012297624B2

(12) United States Patent
Kumagai et al.

(10) Patent No.: US 12,297,624 B2
(45) Date of Patent: May 13, 2025

(54) WORK MACHINE

(71) Applicant: Hitachi Construction Machinery Co., Ltd., Tokyo (JP)

(72) Inventors: Kento Kumagai, Ami-Machi (JP); Shinya Imura, Toride (JP); Yasutaka Tsuruga, Ryugasaki (JP); Takaaki Chiba, Kasumigaura (JP); Shinjirou Yamamoto, Ami-Machi (JP); Hiroaki Amano, Tsukuba (JP); Shinji Nishikawa, Kasumigaura (JP); Akihiro Narazaki, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 18/685,547

(22) PCT Filed: Oct. 31, 2022

(86) PCT No.: PCT/JP2022/040741

§ 371 (c)(1),
(2) Date: Feb. 22, 2024

(87) PCT Pub. No.: WO2023/145182

PCT Pub. Date: Aug. 3, 2023

(65) Prior Publication Data

US 2024/0352710 A1 Oct. 24, 2024

(30) Foreign Application Priority Data

Jan. 25, 2022 (JP) ..... 2022-009752

(51) Int. Cl.
*E02F 9/22* (2006.01)

(52) U.S. Cl.
CPC ..... *E02F 9/2217* (2013.01); *E02F 9/2225* (2013.01); *E02F 9/2285* (2013.01)

(58) Field of Classification Search
CPC ..... E02F 9/2225; E02F 9/2217; E02F 9/2228
See application file for complete search history.

(56) References Cited

U.S. PATENT DOCUMENTS 5,479,778 A 1/1996 Toyooka et al.
5,829,252 A 11/1998 Hirata et al.
(Continued)

FOREIGN PATENT DOCUMENTS

JP 7-158604 A 6/1995
JP 3511425 B2 3/2004
(Continued)

OTHER PUBLICATIONS

International Preliminary Report on Patentability (PCT/IB/338 & PCT/IB/373) issued in PCT Application No. PCT/JP2022/040741 dated Aug. 8, 2024, including English translation (Japanese-language Written Opinion (PCT/ISA/237), filed on Feb. 22, 2024) (5 pages).

(Continued)

*Primary Examiner* — Abiy Teka
*Assistant Examiner* — Daniel S Collins
(74) *Attorney, Agent, or Firm* — Crowell & Moring LLP

(57) ABSTRACT

An object of the present invention is to provide a work machine that makes it possible to perform, with a simple configuration, speed control of respective actuators and thrust control of a particular actuator that regenerates the flow of a return fluid, at the time of combined operation to simultaneously drive the particular actuator and another actuator. For this purpose, a controller calculates a target thrust that is a target value of a thrust of the particular actuator on the basis of an input amount of an operation device and an output value of a posture sensor, calculates a target meter-out pressure that is a target value of a meter-out pressure of the particular actuator on the basis of the target (Continued)

thrust and a meter-in pressure of the particular actuator, and calculates a regeneration control valve target opening area that is a target value of an opening area of a regeneration control valve on the basis of the target meter-out pressure and the meter-out pressure of the particular actuator.

2 Claims, 11 Drawing Sheets

(56) References Cited

U.S. PATENT DOCUMENTS

| | | | |
|---|---|---|---|
| 7,614,336 | B2 | 11/2009 | VerKuilen et al. |
| 2014/0283676 | A1 | 9/2014 | Beschorner |
| 2022/0333348 | A1 | 10/2022 | Kumagai et al. |
| 2023/0022248 | A1* | 1/2023 | Shibata ..... E02F 9/2228 |
| 2023/0235755 | A1 | 7/2023 | Nose et al. |

FOREIGN PATENT DOCUMENTS

| | | | |
|---|---|---|---|
| JP | 5214450 | B2 | 6/2013 |
| JP | 2022-1769 | A | 1/2022 |
| WO | WO 2021/200244 | A1 | 10/2021 |

OTHER PUBLICATIONS

International Search Report (PCT/ISA/210) issued in PCT Application No. PCT/JP2022/040741 dated Jan. 10, 2023 with English translation (4 pages).

Japanese-language Written Opinion (PCT/ISA/237) issued in PCT Application No. PCT/JP2022/040741 dated Jan. 10, 2023 with English translation (5 pages).

* cited by examiner

WORK MACHINE

TECHNICAL FIELD

The present invention relates to a work machine such as a hydraulic excavator.

BACKGROUND ART

Typically, for example, various hydraulic actuators are provided in a work machine such as a hydraulic excavator, and there is a conventionally widely known control circuit for performing fluid supply/discharge control of such hydraulic actuators, the control circuit being configured to perform, with one spool valve, direction switch control to switch the direction of supply/discharge of a hydraulic working fluid to/from a hydraulic actuator, meter-in opening control to control the flow rate of the hydraulic working fluid supplied from a hydraulic pump to the hydraulic actuator, and meter-out opening control to control the flow rate of the hydraulic working fluid discharged from the hydraulic actuator to a hydraulic working fluid tank. In addition, there is a known control circuit that supplies (regenerates the flow of) a fluid (return fluid) discharged from one hydraulic chamber of a hydraulic actuator directly to the other hydraulic chamber.

In the case of the control circuit that performs, with the one spool valve, the meter-in opening control and meter-out opening control of a hydraulic actuator, the relation between the meter-in side opening area and the meter-out side opening area with respect to the movement position of the spool valve is uniquely determined, undesirably. Therefore, there is a possibility that the relation between the meter-in side opening area and the meter-out side opening area cannot be changed according to various types of work contents such as a single action to drive one hydraulic actuator singly, a combined action to simultaneously drive a plurality of hydraulic actuators, light work, or heavy work, and, when the flow rate of the hydraulic working fluid supplied to an actuator is controlled by the meter-in opening control or when the flow rate of the hydraulic working fluid discharged from the actuator is controlled by the meter-out opening control, one type of opening control interferes with the other type of opening control undesirably, and operability lowers undesirably.

In view of this, there is a conventionally known control circuit that performs fluid supply/discharge control of a hydraulic actuator by using a bridge circuit formed by using four metering valves which are head side and rod side supply valves (head end and rod end supply valves) that control the flow rates of a fluid supplied from a hydraulic pump to the head side hydraulic chamber and the rod side hydraulic chamber of a hydraulic cylinder, respectively, and head side and rod side discharge valves (head end and rod end drain valves) that control the flow rates of the fluid discharged from the head side hydraulic chamber and the rod side hydraulic chamber to a fluid tank, respectively (e.g., Patent Document 1). Since the four metering valves are actuated separately on the basis of a command from a controller in the control circuit, it is possible to easily change the relation between meter-in opening and meter-out opening according to work contents or the like.

In addition, there is also a known control circuit in which an auxiliary valve having a variable resistance function is disposed upstream of a directional control valve that performs, with the one spool valve, the direction switch control, meter-in opening control, and meter-out opening control mentioned before, and hydraulic fluid supply to the directional control valve is performed auxiliarily by the auxiliary valve according to work contents or the like such as a single action or a combined action (e.g., Patent Document 2).

PRIOR ART DOCUMENT

Patent Documents

Patent Document 1: JP-5214450-B2
Patent Document 2: JP-3511425-B2

SUMMARY OF THE INVENTION

Problem to be Solved by the Invention

Since the fluid supply/discharge control of one actuator is performed by the four metering valves in the control circuit of Patent Document 1, it is considered that it is possible to realize both speed control of the actuator by the meter-in opening control and thrust control of the actuator by the meter-out opening control. However, since the control circuit requires four drive devices (solenoids in Patent Document 1) for driving four spools (or poppets) included in the four metering valves in addition to the spools, the control circuit has a problem that costs increase due to the complication of the circuit and the increase of the number of parts. In addition, Patent Document 1 does not include a description related to meter-in opening control and meter-out opening control of an actuator to regenerate the flow of a return fluid.

Meanwhile, although the control circuit of Patent Document 2 can control the hydraulic fluid allocation to each actuator or the degrees of priority at the time of a combined action by using the auxiliary valve, meter-in opening control and meter-out opening control of a hydraulic actuator are performed by using one directional control valve as in conventional technologies, and accordingly, the problem that one type of opening control interferes with the other type of opening control undesirably is still left unsolved.

Accordingly, it is not possible to realize both speed control of an actuator by the meter-in opening control and thrust control of the actuator by the meter-out opening control.

The present invention has been made in view of the problems described above, and an object thereof is to provide a work machine that makes it possible to perform, with a simple configuration, speed control of respective actuators and thrust control of a particular actuator that regenerates the flow of a return fluid, at the time of combined operation to simultaneously drive the particular actuator and another actuator.

Means for Solving the Problem

In order to achieve the object described above, the present invention provides a work machine including a machine body, a work implement attached to the machine body, a hydraulic working fluid tank, a variable displacement hydraulic pump that sucks and delivers a hydraulic working fluid from the hydraulic working fluid tank, a regulator that controls a displacement of the hydraulic pump, a plurality of actuators that drive the work implement, a plurality of directional control valves that control a flow of a hydraulic fluid supplied from the hydraulic pump to the plurality of actuators, an operation device that gives an instruction for an action of the plurality of actuators, a regeneration flow path that connects a meter-out flow path connecting a particular directional control valve in the plurality of directional control valves to the hydraulic working fluid tank and a meter-in flow path connecting the particular directional control valve to the hydraulic pump, a regeneration valve that is provided on the regeneration flow path and causes a return fluid of a particular actuator that is one of the plurality of actuators and corresponds to the particular directional control valve to merge with the meter-in flow path from the meter-out flow path, a regeneration control valve that is provided downstream of a point of branch from the regeneration flow path on the meter-out flow path and controls a passing flow rate of the regeneration valve by adjusting a flow rate of the hydraulic fluid returned from the particular actuator to the hydraulic working fluid tank, and a controller that controls the regulator, the plurality of directional control valves, and the regeneration control valve according to an input amount of the operation device. The work machine includes a first pressure sensor that senses a pump pressure that is a delivery pressure of the hydraulic pump, second pressure sensors that sense meter-in pressures and meter-out pressures of the plurality of actuators, and a posture sensor that senses postures and action states of the machine body and the work implement. The plurality of directional control valves are formed by using identical valve bodies and identical housings such that meter-in opening areas become smaller than meter-out opening areas in response to a valve displacement. The controller is configured to calculate an actuator target flow rate that is a target value of a flow rate of the hydraulic fluid supplied from the hydraulic pump to the plurality of actuators on the basis of the input amount of the operation device, calculate an estimated regeneration flow rate that is an estimated value of the passing flow rate of the regeneration valve on the basis of an opening area of the regeneration valve and a meter-in pressure and a meter-out pressure of the particular actuator, calculate a pump target flow rate that is a target value of a delivery flow rate of the hydraulic pump on the basis of the actuator target flow rate and the estimated regeneration flow rate, calculate a target meter-in opening area that is a target value of meter-in opening areas of the plurality of directional control valves on the basis of the actuator target flow rate, the pump pressure, and the meter-in pressure, calculate a target thrust that is a target value of a thrust of the particular actuator on the basis of the input amount of the operation device and an output value of the posture sensor, calculate a target meter-out pressure that is a target value of the meter-out pressure of the particular actuator on the basis of the target thrust and the meter-in pressure of the particular actuator, calculate a regeneration control valve target opening area that is a target value of an opening area of the regeneration control valve on the basis of the target meter-out pressure and the meter-out pressure of the particular actuator, control the regulator according to the pump target flow rate, control the plurality of directional control valves according to the target meter-in opening area, and control the regeneration control valve according to the regeneration control valve target opening area.

According to the thus configured present invention, at the time of combined operation to simultaneously drive the particular actuator that regenerates the flow of the return fluid and the other actuator, the meter-in opening of each directional control valve is adjusted according to the differential pressure across the directional control valve, thereby making it possible to supply the hydraulic fluid at a targeted flow rate to each actuator. In addition, the meter-out opening of the particular directional control valve is adjusted to input a targeted thrust to the particular actuator, thereby making it possible to prevent an excessive movement of an undriven member due to inertia. Then, since the respective directional control valves have a simple configuration formed by using identical valve bodies and identical housings in terms of the meter-in opening areas and the meter-out opening areas, costs can be reduced. This makes it possible to perform, with a simple configuration, speed control of the respective actuators and thrust control of the particular actuator that regenerates the flow of the return fluid, at the time of combined operation to simultaneously drive the particular actuator and the other actuator.

Advantages of the Invention

The work machine according to the present invention makes it possible to perform, with a simple configuration, speed control of a particular actuator that regenerates the flow of a return fluid and another actuator and thrust control of the particular actuator, at the time of combined operation to simultaneously drive the particular actuator and the other actuator.

MODES FOR CARRYING OUT THE INVENTION

Figure 1:
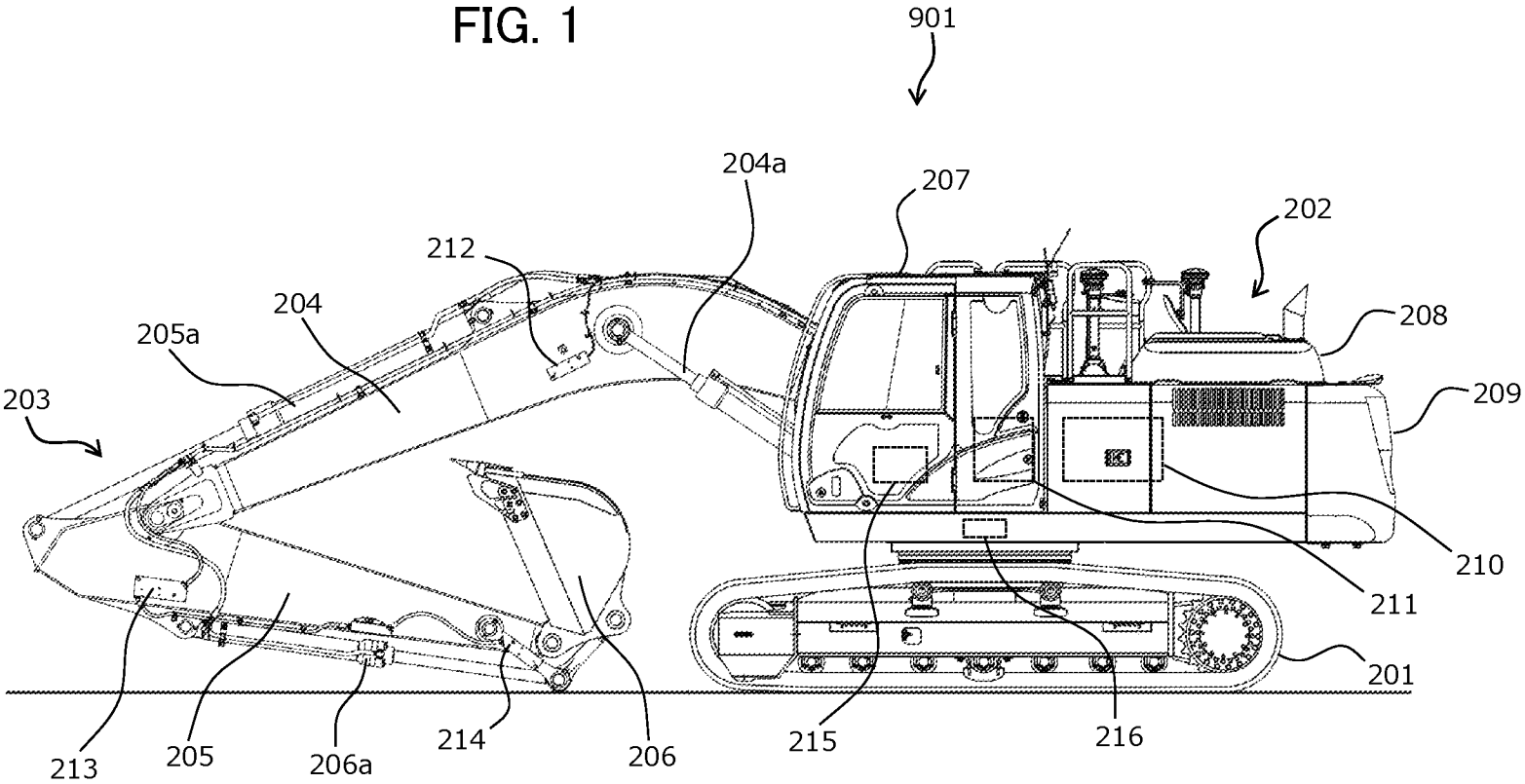
FIG. 1 is a side view of a hydraulic excavator according to an embodiment of the present invention.

Hereinbelow, as an example of a work machine according to an embodiment of the present invention, a hydraulic excavator is explained with reference to the figures. Note that equivalent members in the figures are given identical reference characters, and overlapping explanations are omitted as appropriate.

FIG. 1 is a side view of a hydraulic excavator according to the present embodiment. As depicted in FIG. 1, a hydraulic excavator 901 includes a track structure 201, a swing structure 202 that is arranged swingably on the track structure 201 and included in the machine body, and a work implement 203 that is attached vertically rotatably to the swing structure 202 and performs excavation work of earth and sand and the like. The swing structure 202 is driven by a swing motor 211.

The work implement 203 has a boom 204 attached vertically rotatably to the swing structure 202, an arm 205 attached vertically rotatably to the front end of the boom 204, a bucket 206 attached vertically rotatably to the front end of the arm 205, a boom cylinder 204*a* as an actuator that drives the boom 204, an arm cylinder 205*a* as an actuator that drives the arm 205, and a bucket cylinder 206*a* as an actuator that drives the bucket 206. Inertial measurement units 212, 213, and 214 for sensing the postures and action states of the boom 204, the arm 205, and the bucket 206, respectively, are installed on the work implement 203. Inertial measurement units 215 and 216 for sensing the posture and rotation speed of the swing structure 202 are installed on the swing structure 202. That is, the inertial measurement units 212 to 216 in the present embodiment are included in posture sensors that sense the postures and action states of the swing structure 202 and the work implement 203.

An operation room 207 is provided at a front position on the swing structure 202, and a counter weight 209 for ensuring that the weight balance of the machine body is kept is attached at a rear position on the swing structure 202. A machine room 208 is provided between the operation room 207 and the counter weight 209. The machine room 208 houses an engine (not illustrated), a control valve 210, the swing motor 211, hydraulic pumps 1 to 3 (depicted in FIG. 2A), and the like. The control valve 210 controls the flow of a hydraulic working fluid from the hydraulic pumps to respective actuators.

Figure 2A:
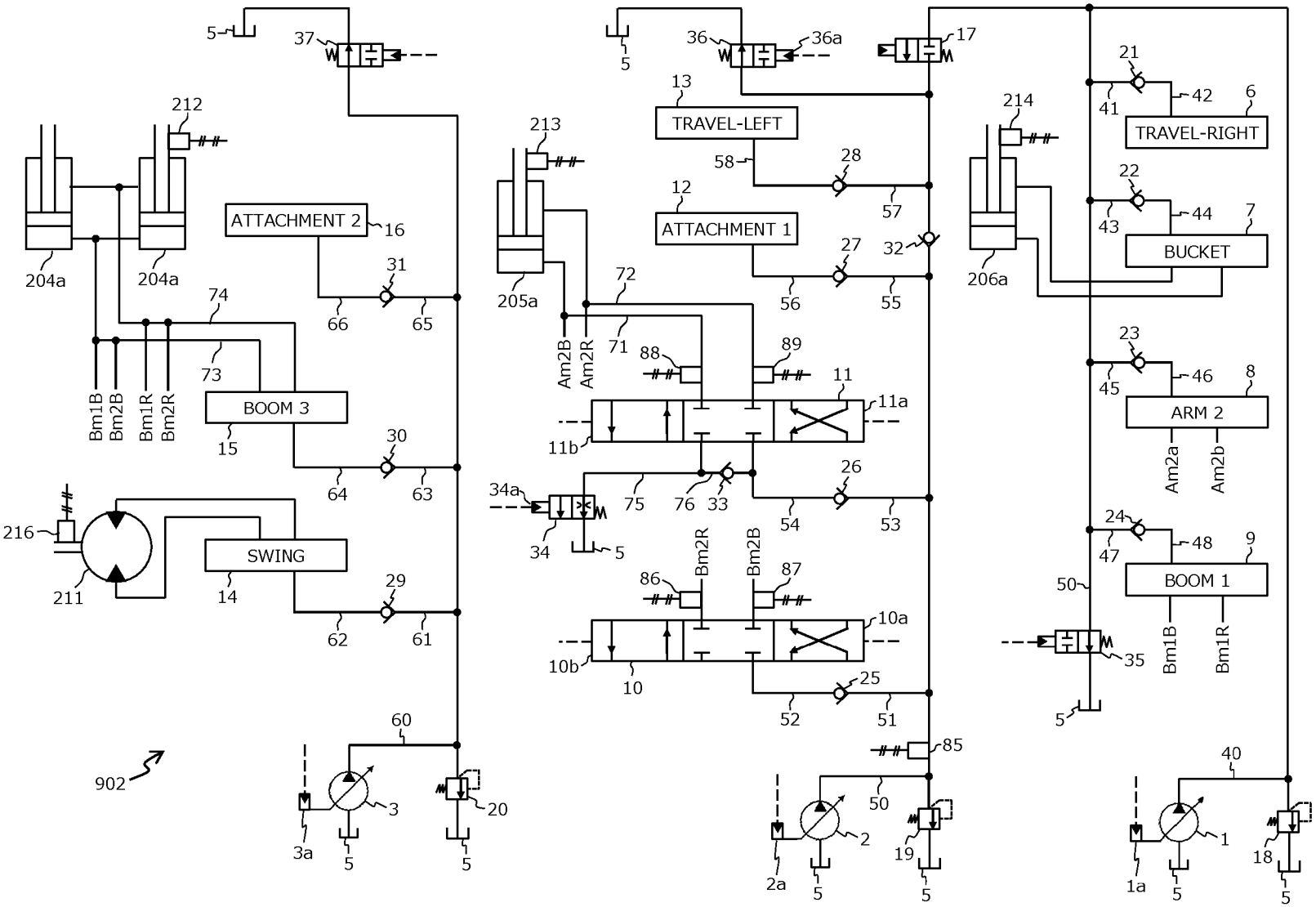
FIG. 2A is a circuit diagram (1/2) of a hydraulic drive system mounted on the hydraulic excavator depicted in FIG. 1.
Figure 2B:
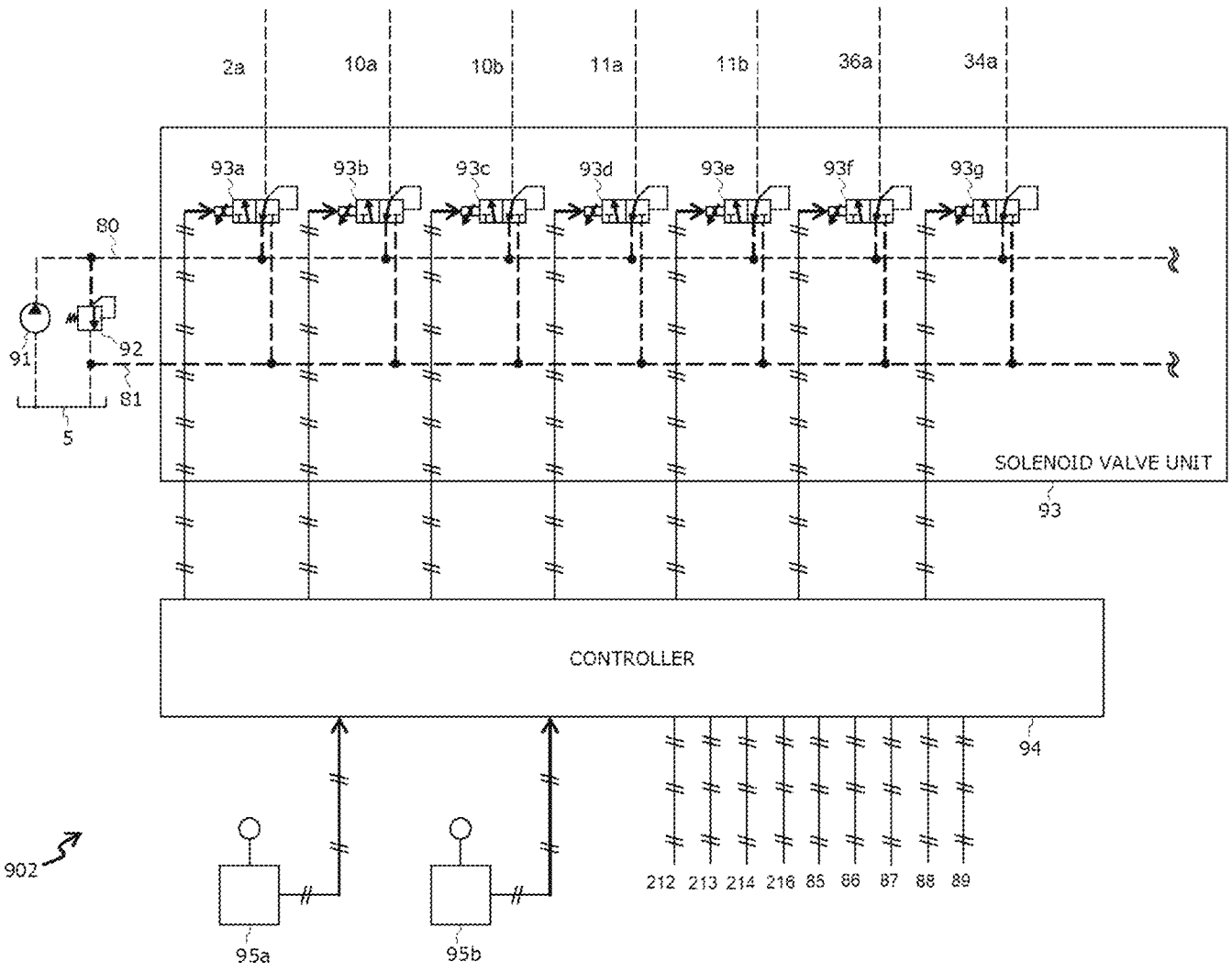
FIG. 2B is a circuit diagram (2/2) of the hydraulic drive system mounted on the hydraulic excavator depicted in FIG. 1.

FIG. 2A and FIG. 2B are circuit diagrams of a hydraulic drive system mounted on the hydraulic excavator 901.

(Configuration)

A hydraulic drive system 902 includes three main hydraulic pumps (e.g., the first hydraulic pump 1, the second hydraulic pump 2, and the third hydraulic pump 3 that include variable displacement hydraulic pumps), a pilot pump 91, and a hydraulic working fluid tank 5 that supplies the fluid to the hydraulic pumps 1 to 3 and the pilot pump 91. The hydraulic pumps 1 to 3 and the pilot pump 91 are driven by the engine (not illustrated).

The tilting angle of the first hydraulic pump 1 is controlled by a regulator provided in association with the first hydraulic pump 1. The regulator of the first hydraulic pump 1 has a flow rate control command pressure port 1*a* and is driven by a command pressure acting on the flow rate control command pressure port 1*a*. The tilting angle of the second hydraulic pump 2 is controlled by a regulator provided in association with the second hydraulic pump 2. The regulator of the second hydraulic pump 2 has a flow rate control command pressure port 2*a* and is driven by a command pressure acting on the flow rate control command pressure port 2*a*. The tilting angle of the third hydraulic pump 3 is controlled by a regulator provided in association with the third hydraulic pump 3. The regulator of the third hydraulic pump 3 has a flow rate control command pressure port 3*a* and is driven by a command pressure acting on the flow rate control command pressure port 3*a*.

A travel-right directional control valve 6, a bucket directional control valve 7, a second arm directional control valve 8, and a first boom directional control valve 9 are connected in parallel on a pump line 40 of the first hydraulic pump 1 via meter-in flow paths 41 and 42, meter-in flow paths 43 and 44, meter-in flow paths 45 and 46, and meter-in flow paths 47 and 48, respectively. In order to prevent reverse flows of the hydraulic fluid to the pump line 40, check valves 21 to 24 are arranged on the meter-in flow paths 41 and 42, the meter-in flow paths 43 and 44, the meter-in flow paths 45 and 46, and the meter-in flow paths 47 and 48, respectively. The travel-right directional control valve 6 controls the flow of the hydraulic fluid supplied from the first hydraulic pump 1 to a travel-right motor that is one of a pair of travel motors for driving the track structure 201 and is not illustrated. The bucket directional control valve 7 controls the flow of the hydraulic fluid supplied from the first hydraulic pump 1 to the bucket cylinder 206*a*. The second arm directional control valve 8 controls the flow of the hydraulic fluid supplied from the first hydraulic pump 1 to the arm cylinder 205*a*. The first boom directional control valve 9 controls the flow of the hydraulic fluid supplied from the first hydraulic pump 1 to the boom cylinder 204*a*. In order to protect the circuit from an excessive pressure increase, the pump line 40 is connected to the hydraulic working fluid tank 5 via a main relief valve 18. In order to discharge an excess delivered fluid of the hydraulic pump 1, the pump line 40 is connected to the hydraulic working fluid tank 5 via a bleed-off valve 35.

A second boom directional control valve 10, a first arm directional control valve 11, a first attachment directional control valve 12, and a travel-left directional control valve 13 are connected in parallel on a pump line 50 of the second hydraulic pump 2 via meter-in flow paths 51 and 52, meter-in flow paths 53 and 54, meter-in flow paths 55 and 56, and meter-in flow paths 57 and 58, respectively. In order to prevent reverse flows of the hydraulic fluid to the pump line 50, check valves 25 to 28 are arranged on the meter-in flow paths 51 and 52, the meter-in flow paths 53 and 54, the meter-in flow paths 55 and 56, and the meter-in flow paths 57 and 58, respectively. The second boom directional control valve 10 controls the flow of the hydraulic fluid supplied from the second hydraulic pump 2 to the boom cylinder 204*a*. The first arm directional control valve 11 controls the flow of the hydraulic fluid supplied from the second hydraulic pump 2 to the arm cylinder 205*a*. The first attachment directional control valve 12 controls the flow of the hydraulic fluid supplied from the second hydraulic pump 2 to, for example, a first actuator that drives a first special attachment such as a secondary crusher provided instead of the bucket 206 and is not illustrated. The travel-left directional control valve 13 controls the flow of the hydraulic fluid supplied from the second hydraulic pump 2 to a travel-left motor that is one of the pair of travel motors for driving the track structure 201 and is not illustrated. In order to protect the circuit from an excessive pressure increase, the pump line 50 is connected to the hydraulic working fluid tank 5 via a main relief valve 19. In order to discharge an excess delivered fluid of the hydraulic pump 2, the pump line 50 is connected to the hydraulic working fluid tank 5 via a bleed-off valve 36. In order to cause the delivered fluid of the first hydraulic pump 1 to merge, the pump line 50 is connected to the pump line 40 via a confluence valve 17. A portion of the pump line 50 at which the meter-in flow path 55 and the meter-in flow path 57 are connected is provided with a check valve 32. The check valve 32 prevents the hydraulic fluid that merges with the pump line 50 from the first hydraulic pump 1 via the confluence valve 17 from flowing into the directional control valves 10 to 12 other than the travel-left directional control valve 13. A meter-out side port of the first arm directional control valve 11 is connected to the hydraulic working fluid tank 5 via a meter-out flow path 75. The meter-out flow path 75 is connected to the meter-in flow path 54 via an arm regeneration flow path 76. The arm regeneration flow path 76 is provided with an arm regeneration valve 33 that permits a flow from the meter-out flow path 75 to the meter-in flow path 54. A regeneration control valve and an arm regeneration control valve 34 that control the passing flow rate of the regeneration valve by adjusting the flow rate of the hydraulic fluid returned from the arm cylinder 205*a* to the hydraulic working fluid tank 5 is installed downstream of a point of branch from the arm regeneration valve 33 on the meter-out flow path 75.

A swing directional control valve 14, a third boom directional control valve 15, and a second attachment directional control valve 16 are connected in parallel on a pump line 60 of the third hydraulic pump 3 via meter-in flow paths 61 and 62, meter-in flow paths 63 and 64, and meter-in flow paths 65 and 66, respectively. In order to prevent reverse flows of the hydraulic fluid to the pump line 60, check valves 29 to 31 are arranged on the meter-in flow paths 61 and 62, the meter-in flow paths 63 and 64, and the meter-in flow paths 65 and 66, respectively. The swing directional control valve 14 controls the flow of the hydraulic fluid supplied from the third hydraulic pump 3 to the swing motor 211. The third boom directional control valve 15 controls the flow of the hydraulic fluid supplied from the third hydraulic pump 3 to the boom cylinder 204*a*. The second attachment directional control valve 16 is used for controlling the flow of the hydraulic fluid supplied to a second actuator when a second special attachment including the second actuator is attached in addition to the first special attachment or when a second special attachment including two actuators, the first actuator and the second actuator, is attached instead of the first special actuator. In order to protect the circuit from an excessive pressure increase, the pump line 60 is connected to the hydraulic working fluid tank 5 via a main relief valve 20. In order to discharge an excess delivered fluid of the hydraulic pump 3, the pump line 60 is connected to the hydraulic working fluid tank 5 via a bleed-off valve 37.

Figure 3:
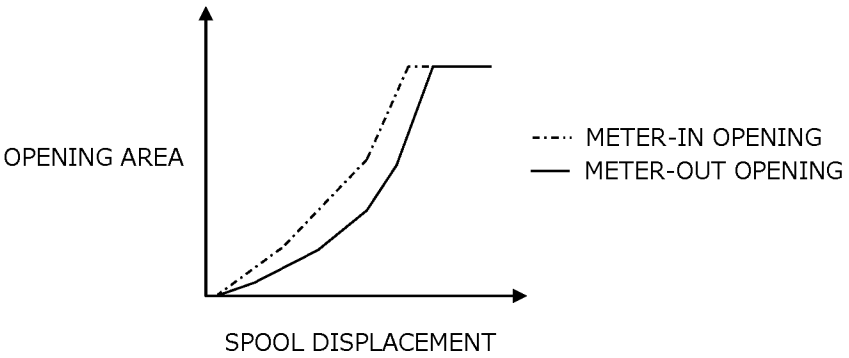
FIG. 3 is a figure depicting opening characteristics of directional control valves depicted in FIG. 2A.
Figure 4:
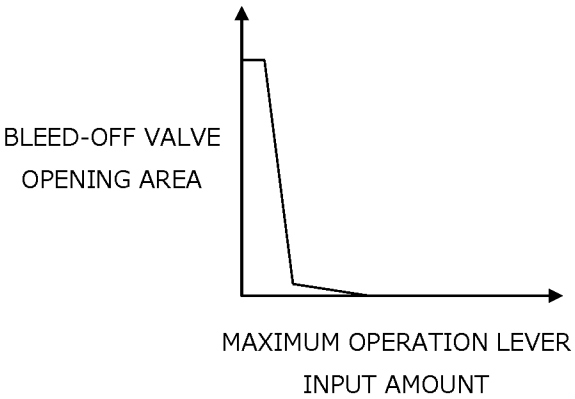
FIG. 4 is a figure depicting opening characteristics of bleed-off valves depicted in FIG. 2A.

FIG. 3 depicts opening characteristics of the directional control valves 6 to 16. In FIG. 3, a meter-in opening area increases from zero to its maximum opening area according to a spool displacement. A meter-out opening area also increases similarly from zero to its maximum opening area according to the spool displacement, but is set to values smaller than the values of the meter-in opening area in relation to the spool displacement. This makes it possible to control the drive speed of an actuator by meter-in opening. FIG. 4 depicts opening characteristics of the bleed-off valves 35 to 37. In FIG. 4, a bleed-off valve opening area is its maximum opening area while a maximum operation lever input amount is within the range from zero to a predetermined value, and decreases sharply to zero once the maximum operation lever input amount exceeds the predetermined value. Note that the maximum operation lever input amount mentioned here is the maximum value of each operation lever input amount corresponding to one of a plurality of actuators connected to a pump line connected with a relevant bleed-off valve.

With reference back to FIG. 2A, a pressure sensor 85 that senses the delivery pressure (pump pressure $P_{Pmp2}$) of the second hydraulic pump 2 is provided on the pump line 50. Pressure sensors 86 and 87 for sensing the meter-in side pressure (boom meter-in pressure $P_{MIBm}$) of the boom cylinder 204*a* are provided on flow paths 73 and 74 connecting the boom cylinder 204*a* and the boom directional control valves 9, 10, and 15. Pressure sensors 88 and 89 for sensing the meter-in side pressure (arm meter-in pressure $P_{MIAm}$) and meter-out side pressure (arm meter-out pressure $P_{MOAm}$) of the arm cylinder 205*a* are provided on flow paths 71 and 72 connecting the arm cylinder 205*a* and the arm directional control valves 8 and 11. Output values of the pressure sensors 85 to 89 are inputted to a controller 94.

In FIG. 2B, a delivery port of the pilot pump 91 is connected to the hydraulic working fluid tank 5 via a pilot relief valve 92 for pilot primary pressure generation, and also is connected to one input port of each of solenoid valves 93*a* to 93*g* built in a solenoid valve unit 93 via a flow path 80. The other input port of each of the solenoid valves 93*a* to 93*f* is connected to the hydraulic working fluid tank 5 via a flow path 81. Each of the solenoid valves 93*a* to 93*g* reduces the pilot primary pressure in accordance with a command signal from the controller 94, and outputs the reduced pilot primary pressure as a command pressure.

An output port of the solenoid valve 93*a* is connected to the flow rate control command pressure port 2*a* of the regulator of the second hydraulic pump 2. Output ports of the solenoid valves 93*b* and 93*c* are connected to pilot ports 10*a* and 10*b* of the second boom directional control valve 10. Output ports of the solenoid valves 93*d* and 93*e* are connected to pilot ports 11*a* and 11*b* of the first arm directional control valve 11. An output port of the solenoid valve 93*f* is connected to a command pressure port 36*a* of the bleed-off valve 36. An output port of the solenoid valve 93*g* is connected to a command pressure port 34*a* of the regeneration control valve 34.

Note that, for simplification of explanation, illustrations of solenoid valves for the flow rate control command pressure ports 1*a* and 3*a* of the regulators of the first hydraulic pump 1 and the third hydraulic pump 3, a solenoid valve for the travel-right directional control valve 6, a solenoid valve for the bucket directional control valve 7, a solenoid valve for the second arm directional control valve 8, a solenoid valve for the first boom directional control valve 9, a solenoid valve for the first attachment directional control valve 12, a solenoid valve for the travel-left directional control valve 13, a solenoid valve for the swing directional control valve 14, a solenoid valve for the third boom directional control valve 15, a solenoid valve for the second attachment directional control valve 16, and solenoid valves for the bleed-off valves 35 and 37 are omitted.

The hydraulic drive system 902 includes a boom operation lever 95*a* capable of switch operation of the first boom directional control valve 9, the second boom directional control valve 10, and the third boom directional control valve 15, and an arm operation lever 95*b* capable of switch operation of the first arm directional control valve 11 and the second arm directional control valve 8. Note that, for simplification of explanation, illustrations of a travel-right operation lever for switch operation of the travel-right directional control valve 6, a bucket operation lever for switch operation of the bucket directional control valve 7, a first attachment operation lever for switch operation of the first attachment directional control valve 12, a travel-left operation lever for switch operation of the travel-left directional control valve 13, a swing operation lever for switch operation of the swing directional control valve 14, and a second attachment operation lever for switch operation of the second attachment directional control valve 16 are omitted.

The hydraulic drive system 902 includes the controller 94. According to input amounts of the operation levers 95*a* and 95*b*, output values of the inertial measurement units 212 to 216, and output values of the pressure sensors 85 to 89, the controller 94 outputs a command signal to the solenoid valves 93*a* to 93*g* (including solenoid valves which are not illustrated) that the solenoid valve unit 93 has.

Figure 5:
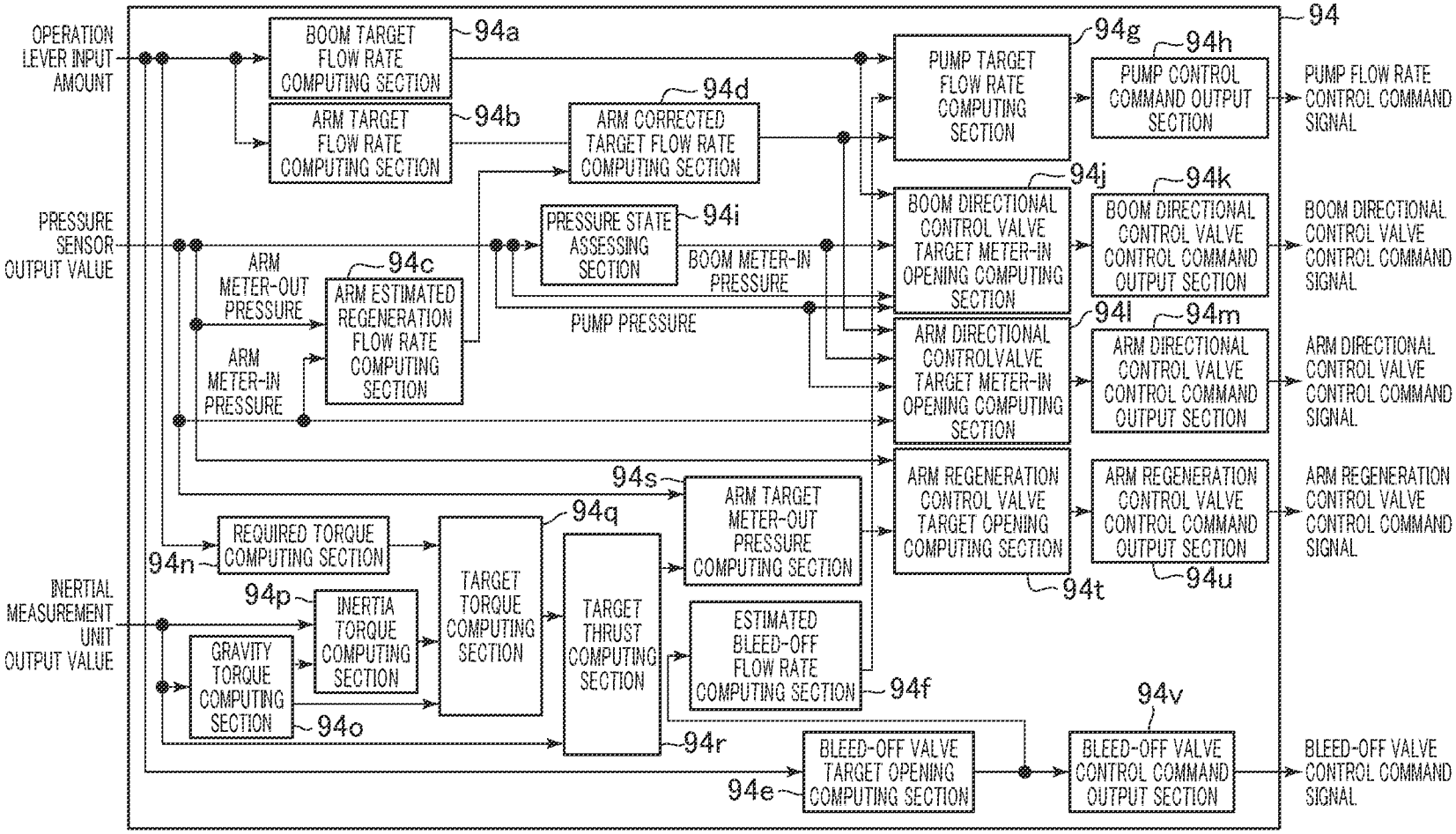
FIG. 5 is a functional block diagram of a controller depicted in FIG. 2B.

FIG. 5 is a functional block diagram of the controller 94. In FIG. 5, the controller 94 has a boom target flow rate computing section 94*a*, an arm target flow rate computing section 94*b*, an arm estimated regeneration flow rate computing section 94*c*, an arm corrected target flow rate computing section 94*d*, a bleed-off valve target opening computing section 94*e*, an estimated bleed-off flow rate computing section 94*f*, a pump target flow rate computing section 94*g*, a pump control command output section 94*h*, a pressure state assessing section 94*i*, a boom directional control valve target meter-in opening computing section 94*j*, a boom directional control valve control command output section 94*k*, an arm directional control valve target meter-in opening computing section 941, an arm directional control valve control command output section 94*m*, a required torque computing section 94*n*, a gravity torque computing section 94*o*, an inertia torque computing section 94*p*, a target torque computing section 94*q*, a target thrust computing section 94*r*, an arm target meter-out pressure computing section 94*s*, an arm regeneration control valve target opening computing section 94*t*, an arm regeneration control valve control command output section 94*u*, and a bleed-off valve control command output section 94*v*.

The boom target flow rate computing section 94*a* calculates a target value (boom target flow rate QTgtBm) of the flow rate (boom flow rate) of the hydraulic fluid supplied to the boom cylinder 204*a* on the basis of an operation lever input amount. Specifically, the boom target flow rate computing section 94*a* calculates the boom target flow rate $Q_{TgtBm}$ according to the operation lever input amount in accordance with preset boom flow rate characteristics in relation to operation lever input amounts. The arm target flow rate computing section 94*b* calculates a target value (arm target flow rate $Q_{tgtAm}$) of the flow rate (arm flow rate) of the hydraulic fluid supplied to the arm cylinder 205*a* on the basis of the operation lever input amount. Specifically, the arm target flow rate computing section 94*b* calculates the arm target flow rate $Q_{TgtAm}$ according to the operation lever input amount in accordance with preset arm flow rate characteristics in relation to operation lever input amounts.

The arm estimated regeneration flow rate computing section 94*c* calculates an arm estimated regeneration flow rate $Q_{EstRegAm}$ on the basis of the arm meter-in pressure $P_{MIAm}$ and arm meter-out pressure $P_{MOAm}$ that are obtained from output values of the pressure sensors 88 and 89, and the opening area of the arm regeneration valve 33. The arm corrected target flow rate computing section 94*d* calculates an arm corrected target flow rate $Q_{ModiTgtAm}$ on the basis of the arm target flow rate $Q_{TgtAm}$ calculated by the arm target flow rate computing section 94*b* and the arm estimated regeneration flow rate $Q_{EstRegAm}$ Calculated by the arm estimated regeneration flow rate computing section 94*c*.

The bleed-off valve target opening computing section 94*e* calculates a target opening area of the bleed-off valves 35 to 37 on the basis of the operation lever input amount. Specifically, the bleed-off valve target opening computing section 94*e* calculates the bleed-off valve target opening area according to the operation lever input amount in accordance with preset bleed-off valve opening area characteristics in relation to operation lever input amounts. The estimated bleed-off flow rate computing section 94*f* calculates an estimated bleed-off flow rate $Q_{EstBO}$ on the basis of a bleed-off valve target opening area $A_{TgtBO}$ calculated by the bleed-off valve target opening computing section 94*e* and the pump pressure $P_{Pmp2}$ obtained from an output value of the pressure sensor 85.

The pump target flow rate computing section 94*g* calculates a pump target flow rate $Q_{TgtPmp}$ on the basis of the boom target flow rate $Q_{TgtBm}$ calculated by the boom target flow rate computing section 94*a*, the arm target flow rate $Q_{TgtAm}$ calculated by the arm target flow rate computing section 94*b*, and the estimated bleed-off flow rate $Q_{EstBO}$ calculated by the estimated bleed-off flow rate computing section 94*f*. The pump control command output section 94*h* outputs, to the solenoid valve 93*a*, a command signal (pump flow rate control command signal) according to the pump target flow rate $Q_{TgtPmp}$ calculated by the pump target flow rate computing section 94*g*, in accordance with preset solenoid valve command signal characteristics in relation to pump flow rates.

The pressure state assessing section 94*i* assesses whether or not a differential pressure across the directional control valve of each actuator is lower than a predetermined threshold on the basis of an output value of a pressure sensor provided on the corresponding actuator line, and outputs assessment results to the boom directional control valve target meter-in opening computing section 94*j*. The boom directional control valve target meter-in opening computing section 94*j* calculates a target meter-in opening area $A_{TgtMIBm}$ Of the boom directional control valves 9, 10, and 15 on the basis of the boom target flow rate calculated by the boom target flow rate computing section 94*a*, the pump pressure obtained from the output value of the pressure sensor 85, the boom meter-in pressure obtained from an output value of the pressure sensor 86 (87), and the assessment results outputted from the pressure state assessing section 941. The boom directional control valve control command output section 94*k* outputs, to the solenoid valve 93*b* (93*c*), a command signal (boom directional control valve control command signal) according to the target meter-in opening area $A_{TgtMIBm}$ calculated by the boom directional control valve target meter-in opening computing section 94*j*, in accordance with preset solenoid valve command signal characteristics in relation to meter-in opening areas.

The arm directional control valve target meter-in opening computing section 941 calculates a target meter-in opening area $A_{TgtMIAm}$ of the arm directional control valves 8 and 11 on the basis of the arm target flow rate calculated by the arm target flow rate computing section 94*b*, the pump pressure obtained from the output value of the pressure sensor 85, the arm meter-in pressure obtained from an output value of the pressure sensor 88 (89), and the assessment results outputted from the pressure state assessing section 94*i*. The arm directional control valve control command output section 94*m* outputs, to the solenoid valve 93*d* (93*e*), a command signal (arm directional control valve control command signal) according to the target meter-in opening area $A_{TgtMIAm}$ Calculated by the arm directional control valve target meter-in opening computing section 941, in accordance with preset solenoid valve command signal characteristics in relation to meter-in opening areas.

The required torque computing section 94*n* calculates a required torque $T_{ReqAm}$ of the arm 205 according to an arm operation lever input amount in accordance with preset arm required torque characteristics in relation to arm operation lever input amounts. The gravity torque computing section 94*o* calculates, as a gravity torque $T_{Gravity}$, a gravity component of an arm moment on the basis of output values of the inertial measurement units 212 to 216 and machine body specification values. The inertia torque computing section

94*p* calculates, as an inertia torque $T_{Inertia}$, an inertia component of the arm moment on the basis of the gravity torque $T_{Gravity}$ calculated by the gravity torque computing section 94*o* and the output values of the inertial measurement units 212 to 216. The target torque computing section 94*q* calculates a target torque $T_{TgtAm}$ of the arm 205 on the basis of the required torque calculated by the required torque computing section 94*n*, the gravity torque $T_{Gravity}$ calculated by the gravity torque computing section 94*o*, and the inertia torque $T_{Inertia}$ calculated by the inertia torque computing section 94*p*. The target thrust computing section 94*r* calculates a target thrust $F_{TgtAm}$ of the arm cylinder 205*a* on the basis of the target torque $T_{TgtAm}$ calculated by the target torque computing section 94*q*, the output values of the inertial measurement units 212 to 216, and the machine body specification values.

The arm target meter-out pressure computing section 94*s* calculates an arm target meter-out pressure $P_{MOTgtAm}$ on the basis of the target thrust $F_{TgtAm}$ of the arm cylinder 205*a* calculated by the target thrust computing section 94*r* and the arm meter-in pressure $P_{MIAm}$ obtained from the output value of the pressure sensor 88 (89). The arm regeneration control valve target opening computing section 94*t* calculates a target opening area $A_{TgtMOAm}$ of the arm regeneration control valve 34 on the basis of the arm target meter-out pressure $P_{MOTgtAm}$ Calculated by the arm target meter-out pressure computing section 94*s* and the arm meter-out pressure $P_{MOAm}$ obtained from the output value of the pressure sensor 88 (89). The arm regeneration control valve control command output section 94*u* outputs, to the solenoid valve 93*g*, a command signal (arm regeneration control valve control command signal) according to the target opening area $A_{TgtMOAm}$ of the arm regeneration control valve 34 calculated by the arm regeneration control valve target opening computing section 94*t*, in accordance with preset command electric signal characteristics of solenoid valves in relation to opening areas of the arm regeneration control valve.

The bleed-off valve control command output section 94*v* outputs, to the solenoid valve 93*f*, a command signal (bleed-off valve control command signal) according to the target opening area $A_{TgtBO}$ calculated by the bleed-off valve target opening computing section 94*e*, in accordance with preset solenoid valve command signal characteristics in relation to opening areas of the bleed-off valves 35 to 37.

Figure 6:
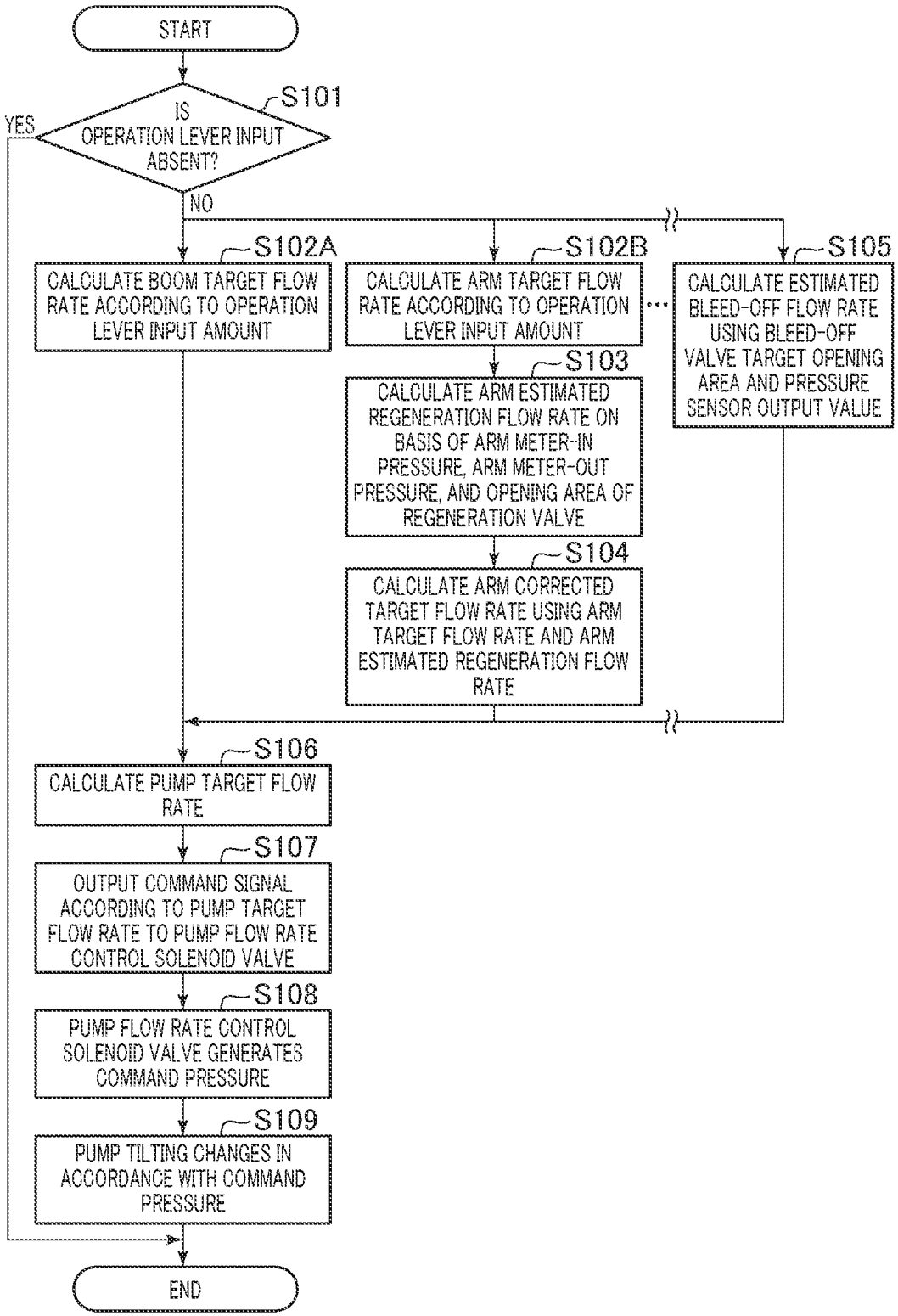
FIG. 6 is a flowchart depicting a process related to pump flow rate control performed by the controller depicted in FIG. 2B.

FIG. 6 is a flowchart depicting a process related to pump flow rate control performed by the controller 94. Hereinbelow, only a process related to flow rate control of the second hydraulic pump 2 is explained. Note that, since processes related to flow rate control of the other hydraulic pumps 1 and 3 are similar to this, explanations thereof are omitted.

First, the controller 94 assesses whether or not operation lever input is absent (Step S101). Operation lever input mentioned here is operation lever input corresponding to the actuators 204*a* and 205*a* connected to the pump line 60 of the second hydraulic pump 2. When it is assessed at Step S101 that operation lever input is absent (YES), the procedure is ended.

When it is assessed at Step S101 that operation lever input is present (NO), the boom target flow rate computing section 94*a* calculates the boom target flow rate $Q_{TgtBm}$ according to the operation lever input amount in accordance with preset boom target flow rate characteristics in relation to operation lever input amounts (Step S102A).

In parallel with Step S102A, the arm target flow rate computing section 94*b* calculates the arm target flow rate $Q_{TgtAm}$ according to the operation lever input amount in accordance with preset arm target flow rate characteristics in relation to operation lever input amounts (Step S102B). Note that, although an illustration is omitted, target flow rates are also calculated similarly for other actuators connected to the pump line 50 of the second hydraulic pump 2.

Subsequently to Step S102B, the arm estimated regeneration flow rate computing section 94*c* calculates the arm estimated regeneration flow rate $Q_{EstRegAm}$ on the basis of the arm meter-in pressure $P_{MIAm}$ and arm meter-out pressure $P_{MOAm}$ that are obtained from output values of the pressure sensors 88 and 89, and the opening area of the arm regeneration valve 33 (Step S103).

Subsequently to Step S103, the arm corrected target flow rate computing section 94*d* calculates the arm corrected target flow rate $Q_{ModiTgtAm}$ in accordance with Formula 1 using the arm target flow rate $Q_{TgtAm}$ calculated by the arm target flow rate computing section 94*b* and the arm estimated regeneration flow rate $Q_{EstRegAm}$ calculated by the arm estimated regeneration flow rate computing section 94*c* (Step S104).

[Math. 1]

$$Q_{ModiTgtAm} = Q_{TgtAm} - Q_{EstRegAm} \quad \text{Formula 1}$$

In parallel with Step S102A or Steps S102B, S103, and S104, the estimated bleed-off flow rate computing section 94*f* calculates the estimated bleed-off flow rate $Q_{EstBO}$ in accordance with Formula 2 using the target opening area $A_{TgtBO}$ of the bleed-off valve 36 calculated by the bleed-off valve target opening computing section 94*e* and the pump pressure $P_{Pmp2}$ obtained from the output value of the pressure sensor 85 (Step S105).

[Math. 2]

$$Q_{EstBO} = Cd \times A_{TgtBO}\sqrt{(2(P_{Pmp2} - P_{Tank})/\rho)} \quad \text{Formula 2}$$

Here, Cd is a flow rate coefficient, $P_{Tank}$ is a tank pressure, and ρ is a hydraulic working fluid density.

Subsequently to Steps S102A, S104, and S105, the pump target flow rate computing section 94*g* calculates the pump target flow rate $Q_{TgtPmp}$ in accordance with Formula 3 using the boom target flow rate $Q_{TgtBm}$, the arm corrected target flow rate $Q_{ModiTgtAm}$, and the estimated bleed-off flow rate $Q_{EstBO}$ (Step S106).

[Math. 3]

$$Q_{TgtPmp} = Q_{TgtBm} + Q_{ModiTgtAm} + \ldots + Q_{EstBO} \quad \text{Formula 3}$$

Subsequently to Step S106, the pump control command output section 94*h* outputs, to the solenoid valve 93*a* for pump flow rate control of the second hydraulic pump 2, a command signal (pump flow rate control command signal) according to the pump target flow rate $Q_{TgtPmp}$ Calculated by the pump target flow rate computing section 94*g*, in accordance with preset solenoid valve command signal characteristics in relation to pump flow rates (Step S107).

Subsequently to Step S107, the solenoid valve 93*a* for pump flow rate control of the second hydraulic pump 2 is caused to generate a command pressure (Step S108), the tilting of the second hydraulic pump 2 is changed in accordance with the command pressure (Step S109), and the procedure ends.

Figure 7:
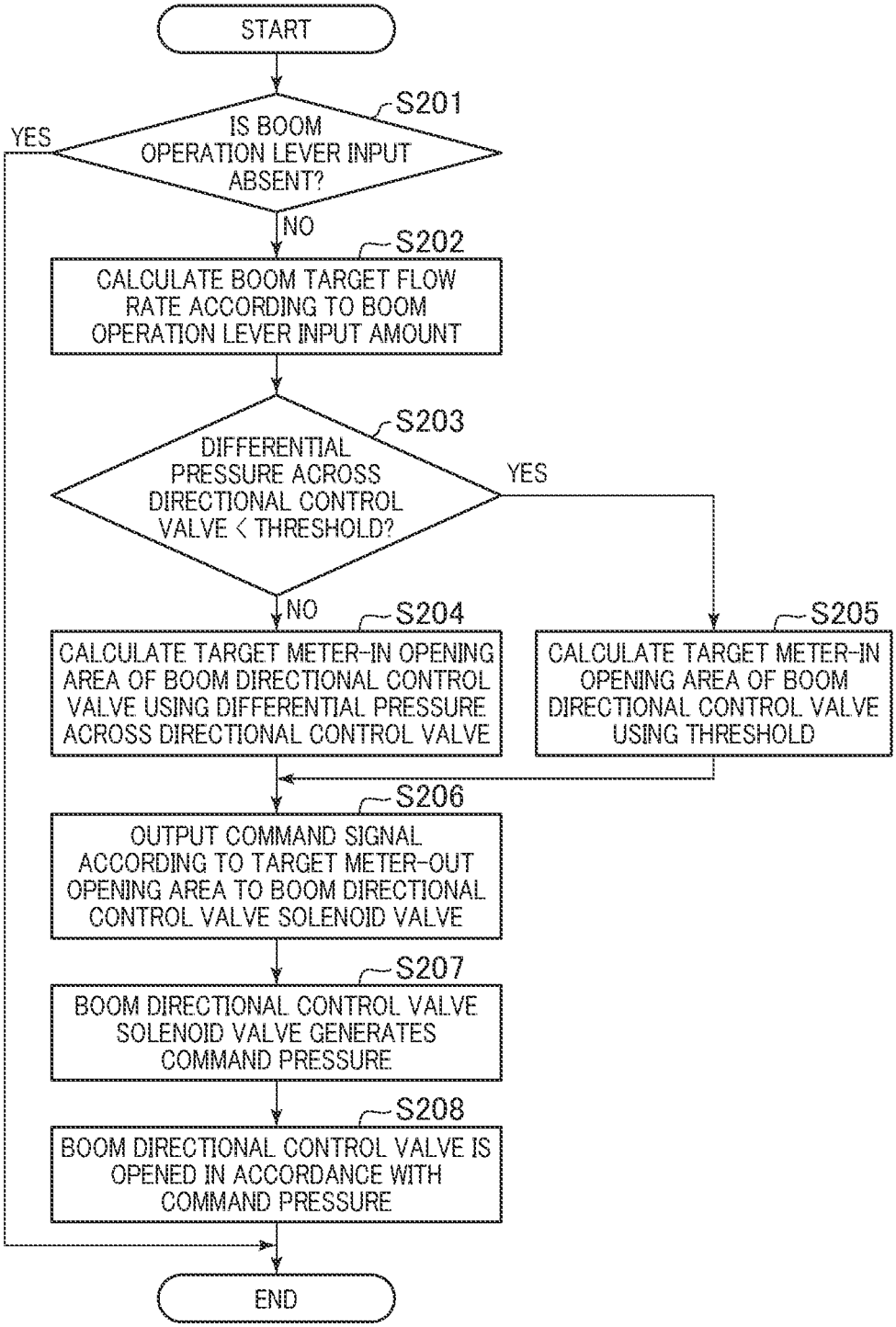
FIG. 7 is a flowchart depicting a process related to opening control of boom directional control valves performed by the controller depicted in FIG. 2B.

FIG. 7 is a flowchart depicting a process related to opening control of the boom directional control valves 9, 10, and 15 performed by the controller 94. Hereinbelow, only a process related to opening control of the second boom directional control valve 10 is explained. Since processes related to opening control of the other boom directional control valves 9 and 15 are similar to this, explanations thereof are omitted.

First, the controller 94 assesses whether or not boom operation lever input is absent (Step S201). When it is assessed at Step S201 that boom operation lever input is absent (YES), the procedure is ended.

When it is assessed at Step S201 that boom operation lever input is present (NO), the boom target flow rate computing section 94*a* calculates the boom target flow rate $Q_{TgtBm}$ according to the boom operation lever input amount in accordance with preset boom target flow rate characteristics in relation to boom operation lever input amounts (Step S202).

Subsequently to Step S202, the pressure state assessing section 94*i* determines whether or not a differential pressure between the pump pressure $P_{Pmp2}$ obtained from an output value of the pressure sensor 85 and the boom meter-in pressure $P_{MIBm}$ obtained from an output value of the pressure sensor 86 (87) (the differential pressure across the second boom directional control valve 10) is lower than a threshold α (Step S203). For example, the threshold α is set to a minimum value of the differential pressure across the directional control valve at which flow rate control precision can be ensured.

When it is assessed at Step S203 that the differential pressure ($P_{Pmp2}$-$P_{MIBm}$) is equal to or greater than the threshold α (NO), the boom directional control valve target meter-in opening computing section 94*j* calculates the target meter-in opening area $A_{TgtMIBm}$ of the second boom directional control valve 10 in accordance with Formula 4 using the boom target flow rate $Q_{TgtBm}$ calculated by the boom target flow rate computing section 94*a*, the pump pressure $P_{pmp2}$ of the second hydraulic pump 2 obtained from the output value of the pressure sensor 85, and the boom meter-in pressure $P_{MIBm}$ obtained from the output value of the pressure sensor 86 (87) (Step S204).

[Math. 4]

$$A_{TgtMIBm} = Q_{TgtBm}/\left(Cd \times \sqrt{\left(2(P_{Pmp2} - P_{MIBm})/\rho\right)}\right) \quad \text{Formula 4}$$

Here, Cd is a flow rate coefficient, and ρ is a hydraulic working fluid density.

When it is assessed at Step S203 that the differential pressure ($P_{Pmp2}$-$P_{MIBm}$) is lower than the threshold α (YES), the boom directional control valve target meter-in opening computing section 94*j* calculates the target meter-in opening area $A_{TgtMIBm}$, as with Step S204, using the threshold α instead of the differential pressure ($P_{Pmp2}$-$P_{MIBm}$) (Step S205).

Subsequently to Step S204 or Step S205, the boom directional control valve control command output section 94*k* outputs, to the solenoid valve 93*b* (93*c*) for the second boom directional control valve 10, a command signal (boom directional control valve control command signal) according to the target meter-in opening area $A_{TgtMIBm}$ calculated by the boom directional control valve target meter-in opening computing section 94*j*, in accordance with preset solenoid valve command signal characteristics in relation to meter-in opening areas of the second boom directional control valve 10 (Step S206).

Subsequently to Step S206, the solenoid valve 93*b* (93*c*) for the second boom directional control valve 10 is caused to generate a command pressure (Step S207), the second boom directional control valve 10 is caused to open in accordance with the command pressure (Step S208), and the procedure ends.

Figure 8:
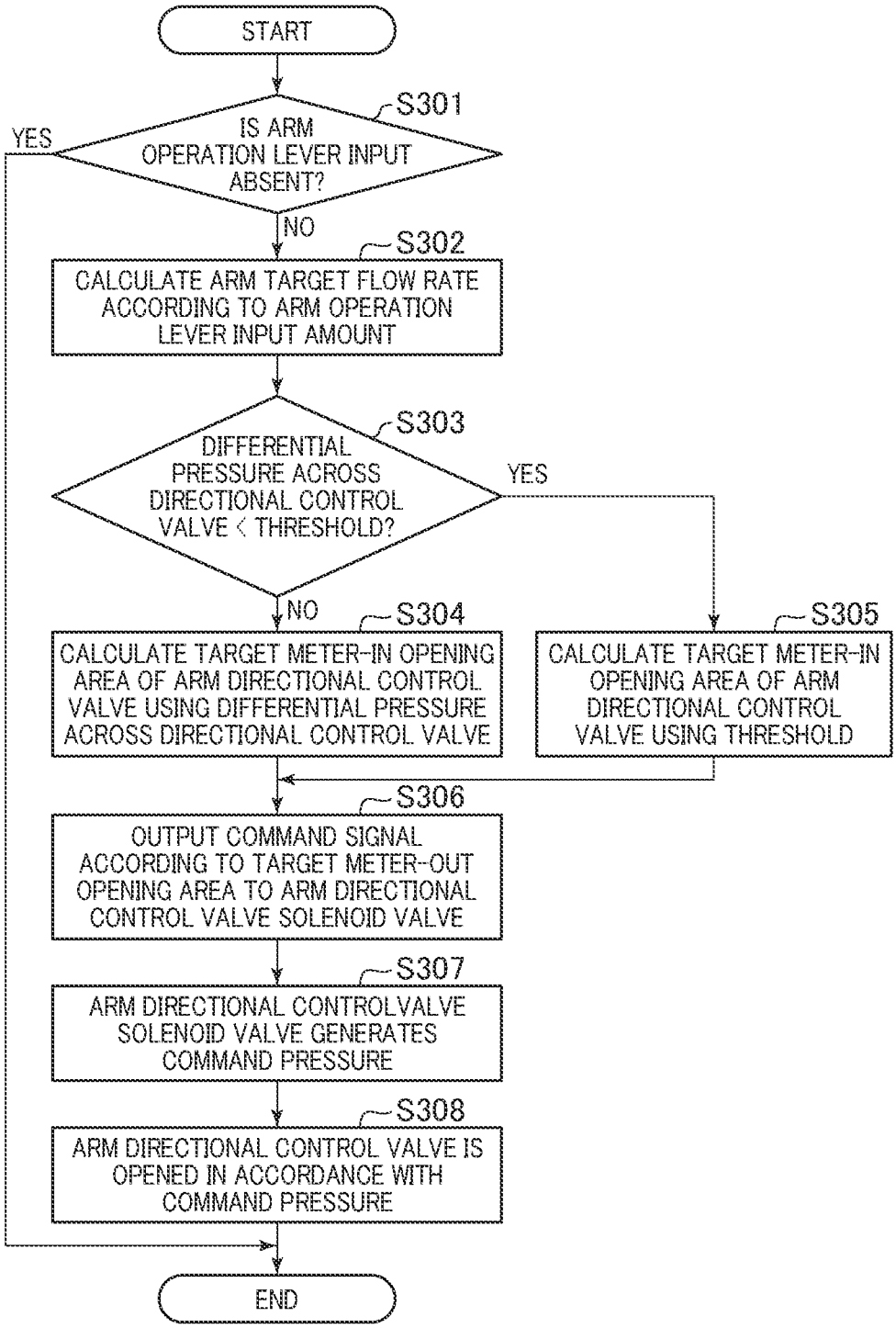
FIG. 8 is a flowchart depicting a process related to opening control of arm directional control valves performed by the controller depicted in FIG. 2B.

FIG. 8 is a flowchart depicting a process related to opening control of the arm directional control valves 8 and 11 performed by the controller 94. Hereinbelow, only a process related to opening control of the first arm directional control valve 11 is explained. Since a process related to opening control of the second arm directional control valve 8 is similar to this, an explanation thereof is omitted.

First, the controller 94 assesses whether or not arm operation lever input is absent (Step S301). When it is assessed at Step S301 that arm operation lever input is absent (YES), the procedure is ended.

When it is assessed at Step S301 that arm operation lever input is present (NO), the arm target flow rate computing section 94*b* calculates the arm target flow rate $Q_{TgtAm}$ according to the arm operation lever input amount in accordance with preset arm target flow rate characteristics in relation to arm operation lever input amounts (Step S302).

Subsequently to Step S302, the pressure state assessing section 94*i* determines whether or not a differential pressure between the pump pressure $P_{Pmp2}$ obtained from an output value of the pressure sensor 85 and the arm meter-in pressure $P_{MIAm}$ obtained from an output value of the pressure sensor 88 (89) (the differential pressure across the first arm directional control valve 11) is lower than the threshold α (Step S303).

When it is assessed at Step S303 that the differential pressure ($P_{Pmp2}$-$P_{MIAm}$) is equal to or greater than the threshold α (NO), the arm directional control valve target meter-in opening computing section 941 calculates the target meter-in opening area $A_{TgtMIAm}$ of the first arm directional control valve 11 in accordance with Formula 5 using the arm target flow rate $Q_{TgtAm}$ calculated by the arm target flow rate computing section 94*b*, the pump pressure $P_{Pmp2}$ of the second hydraulic pump 2 obtained from the output value of the pressure sensor 85, and the arm meter-in pressure $P_{MIAm}$ obtained from the output value of the pressure sensor 88 (89) (Step S304).

[Math. 5]

$$A_{TgtMIAm} = Q_{TgtAm}/\left(Cd \times \sqrt{\left(2(P_{Pmp2} - P_{MIAm})/\rho\right)}\right) \quad \text{Formula 5}$$

Here, Cd is a flow rate coefficient, and ρ is a hydraulic working fluid density.

When it is assessed at Step S303 that the differential pressure ($P_{Pmp2}$-$P_{MIAm}$) is lower than the threshold α (YES), the arm directional control valve target meter-in opening computing section 941 calculates the target meter-in opening area $A_{TgtMIAm}$, as with Step S304, using the threshold α instead of the differential pressure ($P_{Pmp2}$-$P_{MIAm}$) (Step S305).

Subsequently to Step S304 or Step S305, the arm directional control valve control command output section 94*m* outputs, to the solenoid valve 93*d* (93*e*) for the first arm directional control valve 11, a command signal (arm directional control valve control command signal) according to the target meter-in opening area $A_{TgtMIAm}$ Calculated by the arm directional control valve target meter-in opening computing section 941, in accordance with preset solenoid valve command signal characteristics in relation to meter-in opening areas of the first arm directional control valve 11 (Step S306).

Subsequently to Step S306, the solenoid valve 93*d* (93*e*) for the first arm directional control valve 11 is caused to generate a command pressure (Step S307), the first arm directional control valve 11 is caused to open in accordance with the command pressure (Step S308), and the procedure ends.

Figure 9:
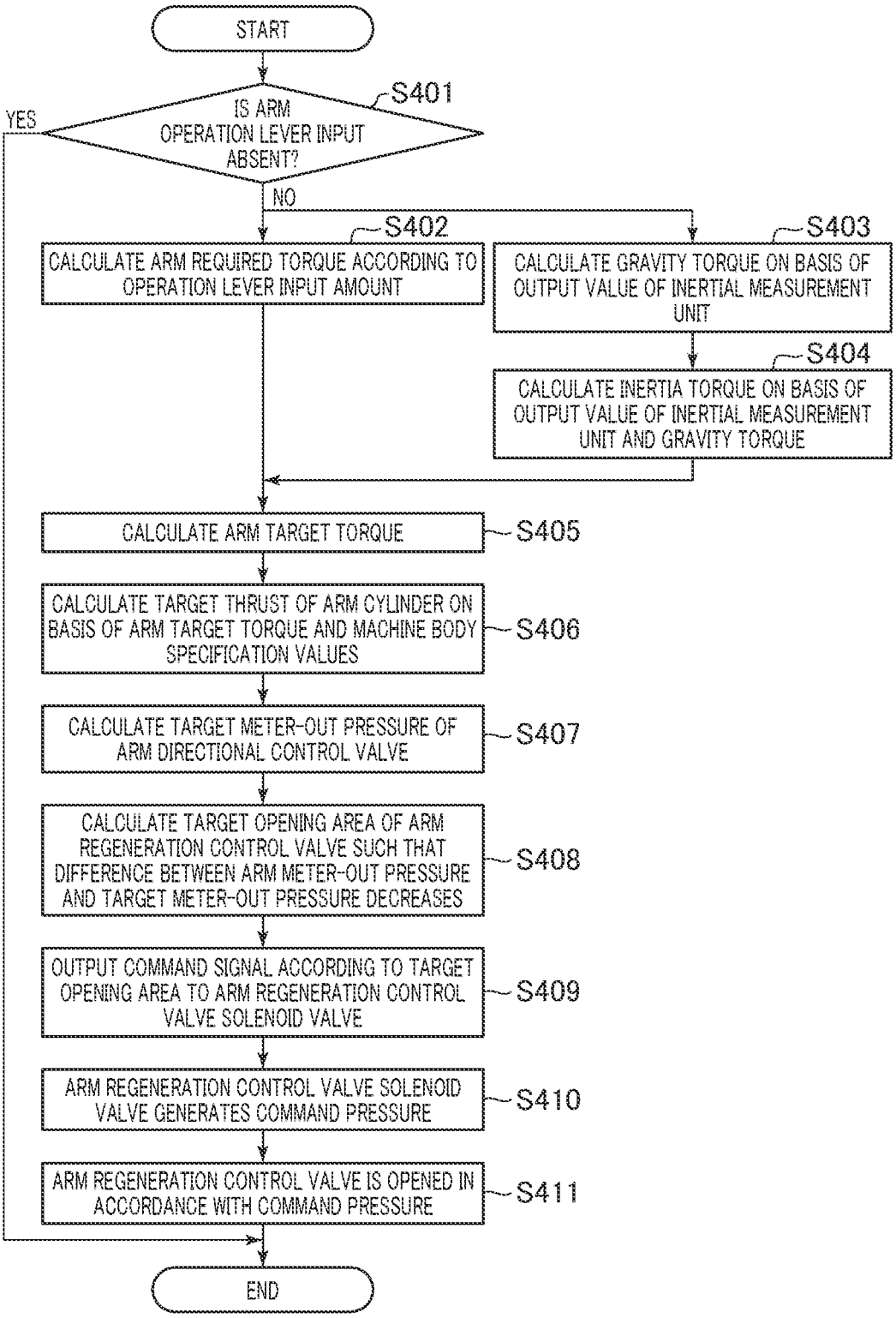
FIG. 9 is a flowchart depicting a process related to opening control of an arm regeneration control valve performed by the controller depicted in FIG. 2B.

FIG. 9 is a flowchart depicting a process related to opening control of the arm regeneration control valve 34 performed by the controller 94.

First, the controller 94 assesses whether or not arm operation lever input is absent (Step S401). When it is assessed at Step S401 that arm operation lever input is absent (YES), the procedure is ended.

When it is assessed at Step S401 that arm operation lever input is present (NO), the required torque computing section 94*n* calculates an arm required torque $T_{ReqAm}$ according to the arm operation lever input amount in accordance with preset arm required torque characteristics in relation to arm operation amount lever input amounts (Step S402).

In parallel with Step S402, the gravity torque computing section 94*o* calculates, as the gravity torque $T_{Gravity}$, the gravity component of an arm moment on the basis of output values of the inertial measurement units 212 to 216 and machine body specification values (mainly, dimensions of the structure, etc.) (Step S403).

Subsequently to Step S403, the inertia torque computing section 94*p* calculates, as the inertia torque $T_{Inertia}$, the inertia component of the arm moment on the basis of the gravity torque $T_{Gravity}$ calculated by the gravity torque computing section 94*o* and the output values of the inertial measurement units 212 to 216 (Step S404).

Subsequently to Steps S402 and S404, the target torque computing section 94*q* calculates an arm target torque $T_{TgtAm}$ in accordance with Formula 6 using the arm required torque $T_{ReqAm}$ calculated by the required torque computing section 94*n*, the gravity torque $T_{Gravity}$ calculated by the gravity torque computing section 94*o* , and the inertia torque $T_{Inertia}$ calculated by the inertia torque computing section 94*p* (Step S405).

[Math. 6]

$$T_{TgtAm} = T_{ReqAm} - T_{Gravity} - T_{Inertia} \quad \text{Formula 6}$$

Here, a torque in a rotation direction that is the same as the direction of the arm required torque $T_{ReqAm}$ is defined as a positive torque.

Subsequently to Step S405, the target thrust computing section 94*r* calculates the target thrust $F_{TgtAm}$ of the arm cylinder 205*a* on the basis of the arm target torque $T_{TgtAm}$ calculated by the target torque computing section 94*q*, the output values of the inertial measurement units 212 to 216, and machine body specification values (Step S406).

Subsequently to Step S406, the arm target meter-out pressure computing section 94*s* calculates the arm target meter-out pressure $P_{MOTgtAm}$ in accordance with Formula 7 using the target thrust $F_{TgtAm}$ calculated by the target thrust computing section 94*r* and the arm meter-in pressure $P_{MIAm}$ obtained from an output value of the pressure sensor 88 (89) (Step S407).

[Math. 7]

$$P_{TgtMOAm} = (S_{MIAm} \times P_{MIAm} - F_{TgtAm})/S_{MOAm} \quad \text{Formula 7}$$

Here, $S_{MIAm}$ is the meter-in side pressure receiving area of the arm cylinder 205*a*, and $S_{MOAm}$ is the meter-out side pressure receiving area of the arm cylinder 205*a*.

Subsequently to Step S407, the arm regeneration control valve target opening computing section 94*t* calculates the target opening area $A_{TgtMOAm}$ of the arm regeneration control valve 34 such that a difference between the arm target meter-out pressure $P_{TgtMOAm}$ Calculated by the arm target meter-out pressure computing section 94*s* and the arm meter-out pressure $P_{MOAm}$ obtained from the output value of the pressure sensor 89 (88) decreases (Step S408).

Subsequently to Step S408, the arm regeneration control valve control command output section 94*u* outputs, to the solenoid valve 93*g* for the arm regeneration control valve 34, a command signal (arm regeneration control valve control command signal) according to the target opening area $A_{TgtMOAm}$ calculated by the arm regeneration control valve target opening computing section 94*t*, in accordance with preset solenoid valve command signal characteristics in relation to opening areas of the arm regeneration control valve 34 (Step S409).

Subsequently to Step S409, the solenoid valve 93*g* is caused to generate a command pressure of the arm regeneration control valve 34 (Step S410), the arm regeneration control valve 34 is caused to open in accordance with the command pressure (Step S411), and the procedure ends.

Figure 10:
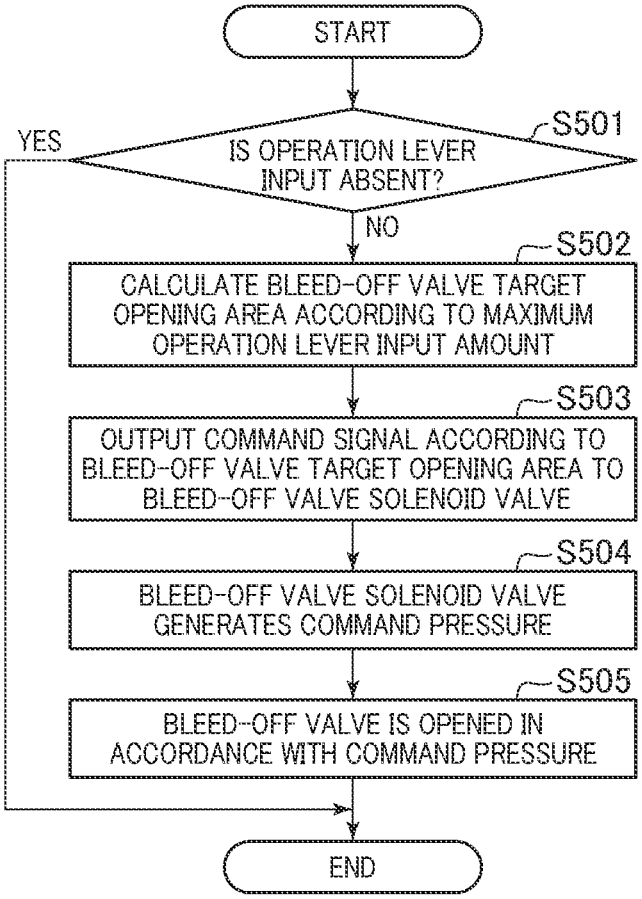
FIG. 10 is a flowchart depicting a process related to opening control of bleed-off valves performed by the controller depicted in FIG. 2B.

FIG. 10 is a flowchart depicting a process related to opening control of the bleed-off valves 35 to 37 performed by the controller 94. Hereinbelow, only a process related to opening control of the bleed-off valve 36 connected to the pump line 50 of the second hydraulic pump 2 is explained. Since processes related to opening control of the other bleed-off valves are similar to this, explanations thereof are omitted.

First, the controller 94 assesses whether or not operation lever input is absent (Step S501). Operation lever input mentioned here is operation lever input corresponding to the actuators 204*a* and 205*a* connected to the pump line 50 of the second hydraulic pump 2. When it is assessed at Step S501 that operation lever input is absent (YES), the procedure is ended.

When it is assessed at Step S501 that operation lever input is present (NO), the bleed-off valve target opening computing section 94*e* calculates the target opening area $A_{TgtBO}$ of the bleed-off valve 36 according to the maximum operation lever input amount in accordance with the bleed-off valve opening characteristics depicted in FIG. 4 (Step S502). Note that the maximum operation lever input amount mentioned here is the maximum value of each operation lever input amount corresponding to the actuators 204*a* and 205*a* connected to the pump line 50 of the second hydraulic pump 2.

Subsequently to Step S502, the bleed-off valve control command output section 94*v* outputs, to the solenoid valve 93*f* for the bleed-off valve 36, a command signal (bleed-off valve control command signal) according to the target opening area $A_{TgtBO}$ of the bleed-off valve 36 in accordance with preset solenoid valve command signal characteristics in relation to opening areas of the bleed-off valve 36 (Step S503).

Subsequently to Step S503, the solenoid valve 93*f* is caused to generate a command pressure of the bleed-off valve 36 (Step S504), the bleed-off valve 36 is caused to open in accordance with the command pressure (Step S505), and the procedure ends.

(Actions)

As examples of actions of the hydraulic drive system 902, actions of the second hydraulic pump 2, the second boom directional control valve 10, the first arm directional control valve 11, the arm regeneration control valve 34, and the bleed-off valve 36 in a case where combined operation to simultaneously drive the boom cylinder 204*a* and the arm cylinder 205*a* is performed are explained.

"Second Hydraulic Pump"

The controller 94 calculates the pump target flow rate $Q_{TgtPmp}$ Of the second hydraulic pump 2 on the basis of input amounts of the boom operation lever 95*a* and the arm operation lever 95*b*, and outputs, to the solenoid valve 93*a*, a command signal (pump flow rate control command signal) according to the pump target flow rate $Q_{TgtPmp}$. The solenoid valve 93*a* generates a command pressure according to the pump flow rate control command signal and drives the delivery flow rate of the second hydraulic pump 2.

"Second Boom Directional Control Valve"

The controller 94 calculates the target meter-in opening area $A_{TgtMIBm}$ on the basis of the boom target flow rate $Q_{TgtBm}$ calculated on the basis of the input amount of the boom operation lever 95*a*, the pump pressure $P_{pmp2}$ sensed by the pressure sensor 85, and the boom meter-in pressure $P_{MIBm}$ sensed by the pressure sensor 86 (87), and outputs, to the solenoid valve 93*b* (93*c*), a command signal (boom directional control valve control command signal) according to the target meter-in opening area $A_{TgtMIBm}$. The solenoid valve 93*b* (93*c*) generates a command pressure according to the boom directional control valve control command signal and controls the meter-in opening area of the second boom directional control valve 10.

"First Arm Directional Control Valve"

The controller 94 calculates the target meter-in opening area $A_{TgtMIAm}$ on the basis of the arm target flow rate $Q_{TgtAm}$ calculated on the basis of the input amount of the arm operation lever 95*b*, the pump pressure $P_{Pmp2}$ sensed by the pressure sensor 85, and the arm meter-in pressure $P_{MIAm}$ sensed by the pressure sensor 88 (89), and outputs, to the solenoid valve 93*d* (93*e*), a command signal (arm directional control valve control command signal) according to the target meter-in opening area $A_{TgtMIAm}$. The solenoid valve 93*d* (93*e*) generates a command pressure according to the arm directional control valve control command signal and controls the meter-in opening area of the first arm directional control valve 11.

"Arm Regeneration Control Valve"

The controller 94 calculates the target opening area $A_{TgtMOAm}$ Of the arm regeneration control valve 34 on the basis of the target torque $T_{TgtAm}$ calculated from the input amount of the arm operation lever 95*b*, the gravity torque $T_{Gravity}$, and the inertia torque $T_{Inertia}$ of the machine body, and the arm meter-in pressure $P_{MIAm}$ and the arm meter-out pressure $P_{MOAm}$ sensed by the pressure sensors 88 and 89, and outputs, to the solenoid valve 93*g*, a command signal (arm regeneration control valve control command signal) according to the target opening area $A_{TgtMOAm}$. The solenoid valve 93*g* generates a command pressure according to the arm regeneration control valve control command signal and controls the opening area of the arm regeneration control valve 34.

"Bleed-Off Valve"

The controller 94 calculates the target opening area $A_{TgtBO}$ of the bleed-off valve 36 on the basis of the input amounts of the boom operation lever 95*a* and the arm operation lever 95*b*, and outputs, to the solenoid valve 93*f*, a command signal (bleed-off valve control command signal) according to the target opening area $A_{TgtBO}$. The solenoid valve 93*f* generates a command pressure according to the bleed-off valve control command signal and controls the opening area of the bleed-off valve 36.

SUMMARY

In the present embodiment, the work machine 901 includes the machine body 202, the work implement 203 attached to the machine body 202, the hydraulic working fluid tank 5, the variable displacement hydraulic pump 2 that sucks and delivers the hydraulic working fluid from the hydraulic working fluid tank 5, the regulator 2*a* that controls the displacement of the hydraulic pump 2, the plurality of actuators 204*a* and 205*a* that drive the work implement 203, the plurality of directional control valves 10 and 11 that control the flows of the hydraulic fluid supplied from the hydraulic pump 2 to the plurality of actuators 204*a* and 205*a*, the operation devices 95*a* and 95*b* that give instructions for actions of the plurality of actuators 204*a* and 205*a*, the regeneration flow path 76 that connects the meter-out flow path 75 connecting the particular directional control valve 11 in the plurality of directional control valves 10 and 11 to the hydraulic working fluid tank 5 and the meter-in flow path 54 connecting the particular directional control valve 11 to the hydraulic pump, the regeneration valve 33 that is provided on the regeneration flow path 76 and causes a return fluid of the particular actuator 205*a* that is one of the plurality of actuators 204*a* and 205*a* and corresponds to the particular directional control valve 11 to merge with the meter-in flow path 54 from the meter-out flow path 75, the regeneration control valve 34 that is provided downstream of the point of branch from the regeneration flow path 76 on the meter-out flow path 75 and controls the passing flow rate of the regeneration valve 33 by adjusting the flow rate of the hydraulic fluid returned from the particular actuator 205*a* to the hydraulic working fluid tank 5, and the controller 94 that controls the regulator 2*a*, the plurality of directional control valves 10 and 11, and the regeneration control valve 34 according to input amounts of the operation devices 95*a* and 95*b*. The work machine 901 includes the first pressure sensor 85 that senses a pump pressure that is the delivery pressure of the hydraulic pump 2, the second pressure sensors 86 to 89 that sense the meter-in pressures $P_{MIBm}$ and $P_{MIAm}$ and meter-out pressures $P_{MOBm}$ and $P_{MOAm}$ of the plurality of actuators 204*a* and 205*a*, and the posture sensors 212 to 216 that sense the postures and action states of the machine body 202 and the work implement 203. The plurality of directional control valves 10 and 11 are formed by using identical valve bodies and identical housings such that meter-in opening areas become smaller than meter-out opening areas in response to a valve displacement. The controller 94 is configured to calculate the actuator target flow rates $Q_{TgtBm}$ and $Q_{TgtAm}$ that are target values of the flow rates of the hydraulic fluid supplied from the hydraulic pump 2 to the plurality of actuators 204*a* and 205*a* on the basis of the input amounts of the operation devices 95*a* and 95*b*, calculate the estimated regeneration flow rate $Q_{EstRegAm}$ that is an estimated value of the passing flow rate of the regeneration valve 33 on the basis of the opening area of the regeneration valve 33 and the meter-in pressure $P_{MIAm}$ and meter-out pressure $P_{MOAm}$ Of the particular actuator 205*a*, calculate the pump target flow rate $Q_{TgtPmp}$ that is a target value of the delivery flow rate of the hydraulic pump 2 on the basis of the actuator target flow rates $Q_{TgtBm}$ and $Q_{TgtAm}$ and the estimated regeneration flow rate $Q_{EstRegAm}$, calculate the target meter-in opening areas $A_{TgtMIBm}$ and $A_{TgtMIAm}$ that are target values of the meter-in opening areas of the plurality of directional control valves 10 and 11 on the basis of the actuator target flow rates $Q_{TgtBm}$ and $Q_{TgtAm}$, the pump pressure $P_{Pmp2}$, and the meter-in pressures $P_{MIBm}$ and $P_{MIAm}$, calculate the target thrust $F_{TgtAm}$ that is a target value of the thrust of the particular actuator 205*a* on the basis of the input amount of the operation device 95*b* and output values of the posture sensors 212 to 216, calculate the target meter-out pressure $P_{MOTgtAm}$ that is a target value of the meter-out pressure $P_{MOAm}$ Of the particular actuator 205*a* on the basis of the target thrust $F_{TgtAm}$ and the meter-in pressure $P_{MIAm}$ of the particular actuator 205*a*, calculate the regeneration control valve target opening area $A_{TgtMOAm}$ that is a target value of the opening area of the regeneration control valve 34 on the basis of the target meter-out pressure $P_{MOTgtAm}$ and the meter-out pressure $P_{MOAm}$ of the particular actuator 205*a*, control the regulator 2*a* according to the pump target flow rate $Q_{Tgtpmp}$, control the plurality of directional control valves 10 and 11 according to the target meter-in opening areas $A_{TgtMIBm}$ and $A_{TgtMIAm}$, and control the regeneration control valve 34 according to the regeneration control valve target opening area $A_{TgtMOAm}$.

According to the thus configured present embodiment, at the time of combined operation to simultaneously drive the arm cylinder 205*a* (the particular actuator that regenerates the flow of the return fluid) and the boom cylinder 204*a* (another actuator), the meter-in opening of each of the directional control valves 10 and 11 is adjusted according to the differential pressure across the directional control valve, thereby making it possible to supply the hydraulic fluid at a targeted flow rate to each actuator 204*a* or 205*a*. In addition, the meter-out opening of the arm directional control valve 11 is adjusted to input a targeted thrust to the arm cylinder 205*a*, thereby making it possible to prevent an excessive movement of an undriven member (the arm 205) due to inertia. Then, since the respective directional control valves 10 and 11 have a simple configuration formed by using identical valve bodies and identical housings in terms of the meter-in opening areas and the meter-out opening areas, costs can be reduced. This makes it possible to perform, with a simple configuration, speed control of the respective actuators 204*a* and 205*a* and thrust control of the particular actuator 205*a* that regenerates the flow of the return fluid, at the time of combined operation to simultaneously drive the particular actuator 205*a* and the other actuator 204*a*.

In addition, the work machine 901 in the present embodiment includes the bleed-off valve 36 that discharges the hydraulic working fluid delivered from the hydraulic pump 3, to the hydraulic working fluid tank 5, and the controller 94 is configured to calculate the bleed-off valve target opening area $A_{TgtBO}$ that is a target value of the opening area of the bleed-off valve 36 on the basis of the input amounts of the operation devices 95*a* and 95*b*, calculate the estimated bleed-off flow rate $Q_{EstBO}$ that is an estimated value of the passing flow rate of the bleed-off valve 36 on the basis of the bleed-off valve target opening area $A_{TgtBO}$ and the pump pressure $P_{Pmp2}$/and calculate the pump target flow rate $Q_{TgtPmp}$ on the basis of the actuator target flow rates $Q_{TgtBm}$ and $Q_{TgtAm}$, the estimated regeneration flow rate $Q_{EstRegAm}$, and the estimated bleed-off flow rate $Q_{EstBO}$. This makes it possible to prevent sudden movements of the actuators 204*a* and 205*a* at the start of operation of the actuators 204*a* and 205*a* since an excess amount of the delivered fluid of the hydraulic pump 3 is discharged to the hydraulic working fluid tank 5.

While an embodiment of the present invention has been mentioned in detail thus far, the present invention is not limited to the embodiment described above and incorporates various modification examples. For example, the embodiment described above is explained in detail in order to explain the present invention in an easy-to-understand manner, and the present invention is not necessarily limited to ones including all the constituent elements explained.

DESCRIPTION OF REFERENCE CHARACTERS

1: First hydraulic pump
1*a*: Flow rate control command pressure port (regulator)
2: Second hydraulic pump
2*a*: Flow rate control command pressure port (regulator)
3: Third hydraulic pump
3*a*: Flow rate control command pressure port (regulator)
5: Hydraulic working fluid tank
6: Travel-right directional control valve
7: Bucket directional control valve
8: Second arm directional control valve
9: First boom directional control valve
10: Second boom directional control valve
10*a*, 10*b*: Pilot port
11: First arm directional control valve
11*a*, 11*b*: Pilot port
12: First attachment directional control valve
13: Travel-left directional control valve
14: Swing directional control valve
15: Third boom directional control valve
16: Second attachment directional control valve
17: Confluence valve
18 to 20: Main relief valve
21 to 32: Check valve
33: Arm regeneration valve
34: Arm regeneration control valve
34*a*: Command pressure port
35 to 37: Bleed-off valve
36*a*: Command pressure port
40: Pump line
41 to 48: Meter-in flow path
50: Pump line
51 to 58: Meter-in flow path
60: Pump line
61 to 66: Meter-in flow path
71 to 74: Flow path
75: Meter-out flow path
76: Arm regeneration flow path
80, 81: Flow path
85: First pressure sensor
86, 87: Second pressure sensor
88, 89: Second pressure sensor
91: Pilot pump
92: Pilot relief valve
93: Solenoid valve unit
93*a* to 93*g*: Solenoid valve
94: Controller
94*a*: Boom target flow rate computing section
94*b*: Arm target flow rate computing section

94*c*: Arm estimated regeneration flow rate computing section
94*d*: Arm corrected target flow rate computing section
94*e*: Bleed-off valve target opening computing section
94*f*: Estimated bleed-off flow rate computing section
94*g*: Pump target flow rate computing section
94*h*: Pump control command output section
94*i*: Pressure state assessing section
94*j*: Boom directional control valve target meter-in opening computing section
94*k*: Boom directional control valve control command output section
94*l*: Arm directional control valve target meter-in opening computing section
94*m*: Arm directional control valve control command output section
94*n*: Required torque computing section
94*o*: Gravity torque computing section
94*p*: Inertia torque computing section
94*q*: Target torque computing section
94*r*: Target thrust computing section
94*s*: Arm target meter-out pressure computing section
94*t*: Arm regeneration control valve target opening computing section
94*u*: Arm regeneration control valve control command output section
94*v*: Bleed-off valve control command output section
95*a*: Boom operation lever (operation device)
95*b*: Arm operation lever (operation device)
201: Track structure
202: Swing structure (machine body)
203: Work implement
204: Boom
204*a*: Boom cylinder (actuator)
205: Arm
205*a*: Arm cylinder (actuator)
206: Bucket
206*a*: Bucket cylinder (actuator)
207: Operation room
208: Machine room
209: Counter weight
210: Control valve
211: Swing motor
212 to 216: Inertial measurement unit (posture sensor)
901: Hydraulic excavator (work machine)
902: Hydraulic drive system

The invention claimed is:

1. A work machine comprising:

a machine body;

a work implement attached to the machine body;

a hydraulic working fluid tank;

a variable displacement hydraulic pump that sucks and delivers a hydraulic working fluid from the hydraulic working fluid tank;

a regulator that controls a displacement of the hydraulic pump;

a plurality of actuators that drive the work implement;

a plurality of directional control valves that control a flow of a hydraulic fluid supplied from the hydraulic pump to the plurality of actuators;

an operation device that gives an instruction for an action of the plurality of actuators;

a regeneration flow path that connects a meter-out flow path connecting a particular directional control valve in the plurality of directional control valves to the hydraulic working fluid tank, and a meter-in flow path connecting the particular directional control valve to the hydraulic pump;

a regeneration valve that is provided on the regeneration flow path and causes a return fluid of a particular actuator that is one of the plurality of actuators and corresponds to the particular directional control valve to merge with the meter-in flow path from the meter-out flow path;

a regeneration control valve that is provided downstream of a point of branch from the regeneration flow path on the meter-out flow path and controls a passing flow rate of the regeneration valve by adjusting a flow rate of the hydraulic fluid returned from the particular actuator to the hydraulic working fluid tank; and a controller that controls the regulator, the plurality of directional control valves, and the regeneration control valve according to an input amount of the operation device, wherein the work machine includes a first pressure sensor that senses a pump pressure that is a delivery pressure of the hydraulic pump, second pressure sensors that sense meter-in pressures and meter-out pressures of the plurality of actuators, and a posture sensor that senses postures and action states of the machine body and the work implement, the plurality of directional control valves are formed by using identical valve bodies and identical housings such that meter-in opening areas become smaller than meter-out opening areas in response to a valve displacement, and the controller is configured to calculate an actuator target flow rate that is a target value of a flow rate of the hydraulic fluid supplied from the hydraulic pump to the plurality of actuators on a basis of the input amount of the operation device, calculate an estimated regeneration flow rate that is an estimated value of the passing flow rate of the regeneration valve on a basis of an opening area of the regeneration valve and a meter-in pressure and a meter-out pressure of the particular actuator, calculate a pump target flow rate that is a target value of a delivery flow rate of the hydraulic pump on a basis of the actuator target flow rate and the estimated regeneration flow rate, calculate a target meter-in opening area that is a target value of meter-in opening areas of the plurality of directional control valves on a basis of the actuator target flow rate, the pump pressure, and the meter-in pressure, calculate a target thrust that is a target value of a thrust of the particular actuator on a basis of the input amount of the operation device and an output value of the posture sensor, calculate a target meter-out pressure that is a target value of the meter-out pressure of the particular actuator on a basis of the target thrust and the meter-in pressure of the particular actuator, calculate a regeneration control valve target opening area that is a target value of an opening area of the regeneration control valve on a basis of the target meter-out pressure and the meter-out pressure of the particular actuator, control the regulator according to the pump target flow rate, control the plurality of directional control valves according to the target meter-in opening area, and control the regeneration control valve according to the regeneration control valve target opening area.

2. The work machine according to claim 1, comprising:

a bleed-off valve that discharges the hydraulic working fluid delivered from the hydraulic pump, to the hydraulic working fluid tank, wherein the controller is configured to calculate a bleed-off valve target opening area that is a target value of an opening area of the bleed-off valve on a basis of the input amount of the operation device, calculate an estimated bleed-off flow rate that is an estimated value of a passing flow rate of the bleed-off valve on a basis of the bleed-off valve target opening area and the pump pressure, and calculate the pump target flow rate on a basis of the actuator target flow rate, the estimated regeneration flow rate, and the estimated bleed-off flow rate.

* * * * *